US009835339B2

(12) United States Patent
Min

(10) Patent No.: US 9,835,339 B2
(45) Date of Patent: Dec. 5, 2017

(54) INDUCTION VENTILATION SYSTEM FOR AIR SUPPLY AND EXHAUST

(71) Applicant: HOMECOOVEN CO., LTD, Seoul (KR)

(72) Inventor: Jung Ho Min, Gwangmyeong (KR)

(73) Assignee: HOMECOOVEN CO., LTD, Seoul (KR)

( * ) Notice: Subject to any disclaimer, the term of this patent is extended or adjusted under 35 U.S.C. 154(b) by 35 days.

(21) Appl. No.: 14/809,209

(22) Filed: Jul. 25, 2015

(65) Prior Publication Data

US 2016/0091211 A1 Mar. 31, 2016

(30) Foreign Application Priority Data

Sep. 29, 2014 (KR) ..... 10-2014-0130038

(51) Int. Cl.
*F24C 15/20* (2006.01)

(52) U.S. Cl.
CPC ..... *F24C 15/2064* (2013.01); *F24C 15/2028* (2013.01); *F24C 15/2042* (2013.01); *F24C 15/2085* (2013.01); *F24C 15/2092* (2013.01)

(58) Field of Classification Search
CPC ..... F02M 1/00
USPC ..... 126/299 R, 299 D
See application file for complete search history.

(56) References Cited

U.S. PATENT DOCUMENTS 3,011,492 A * 12/1961 Humbert ..... F24C 15/12 126/299 R
3,537,442 A * 11/1970 Berger ..... F24C 15/2085 126/21 R
4,899,028 A * 2/1990 Arai ..... F24C 15/101 126/21 A
4,945,891 A * 8/1990 Cecil ..... F24C 15/2092 126/299 D
2003/0089243 A1* 5/2003 Chung ..... A23L 5/11 99/451

* cited by examiner

*Primary Examiner* — Avinash Savani
(74) *Attorney, Agent, or Firm* — Lex IP Meister, PLLC

(57) ABSTRACT

Disclosed is an induction ventilation system for air supply and exhaust, including: an upper plate that has an induction heating portion thereon and a lift hole in a rear portion thereof; a vertically movable unit that moves up and down through the lift hole and is equipped with a filter; an air suction and discharge unit including a chamber with an oil drain hole, a flexible duct connected between the vertically movable unit and the chamber, an air suction fan, and a discharge pipe through which indoor air drawn by the air suction fan is discharged outside; a grease tray installed under the chamber to collect grease that is condensed on the surface of an air suction passage; and an air supply hood that guides the indoor air to the air suction passage by supplying air to the upper plate using an air supply fan.

4 Claims, 7 Drawing Sheets

[Fig. 1]
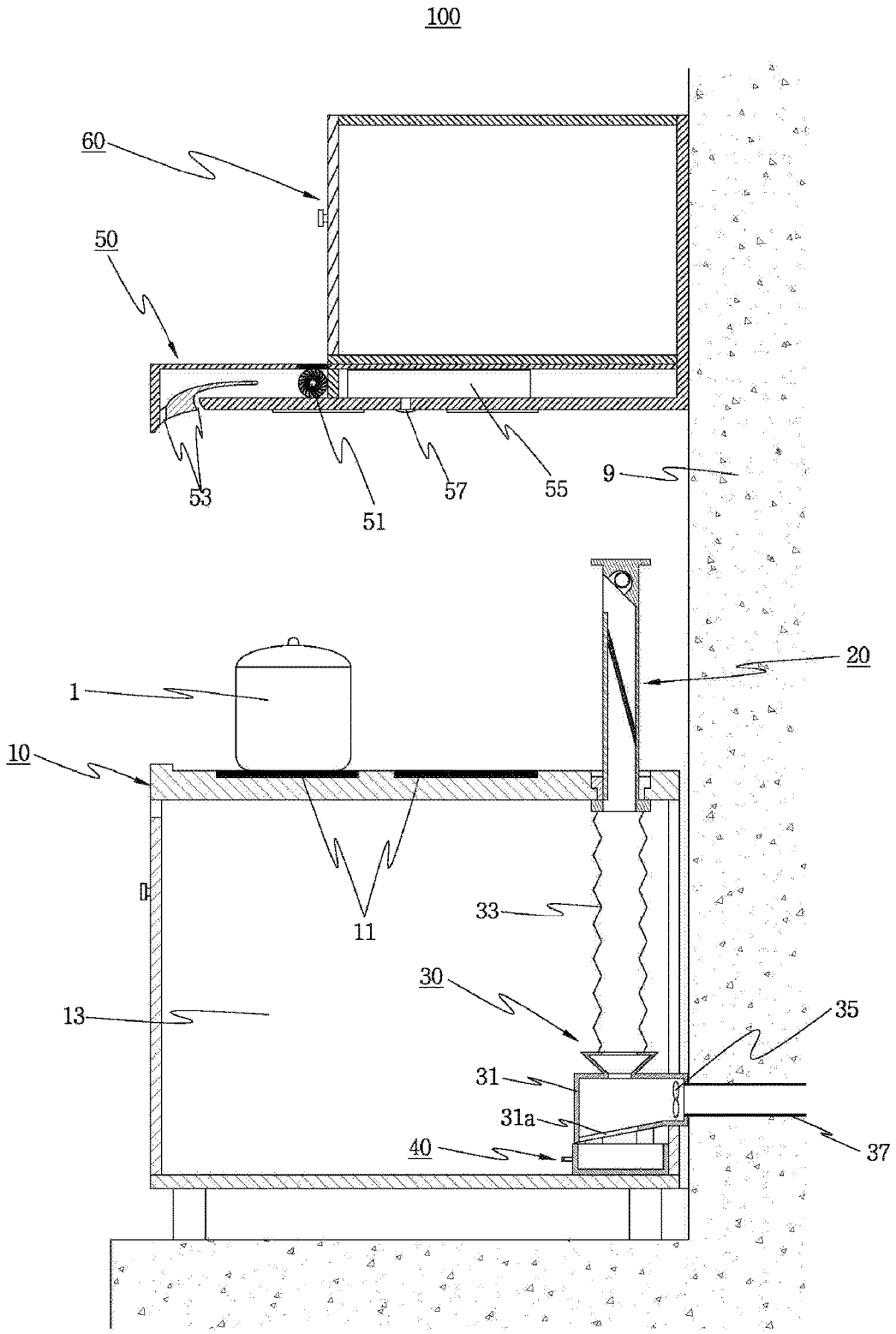

[Fig. 2]
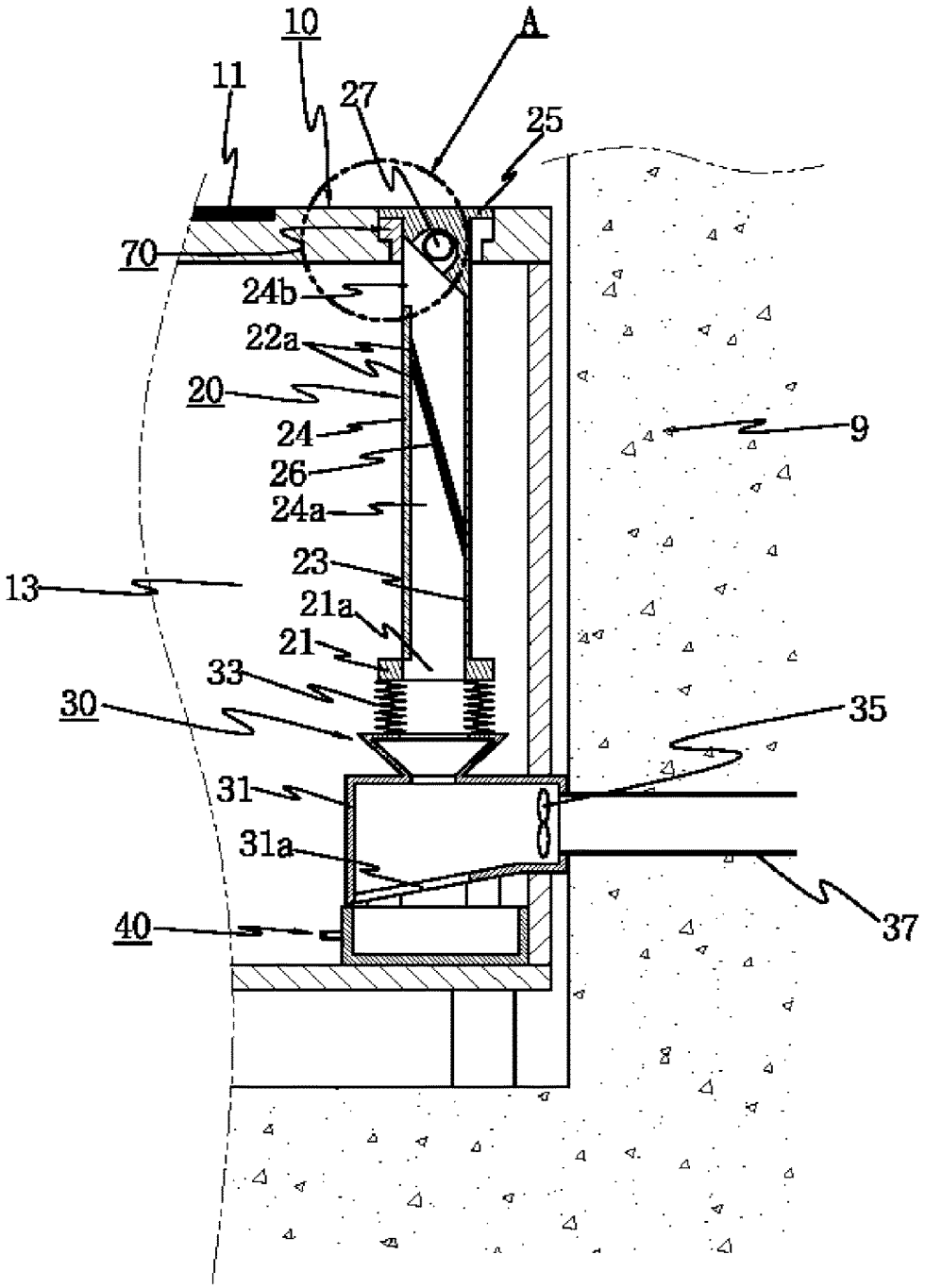

[Fig. 3]
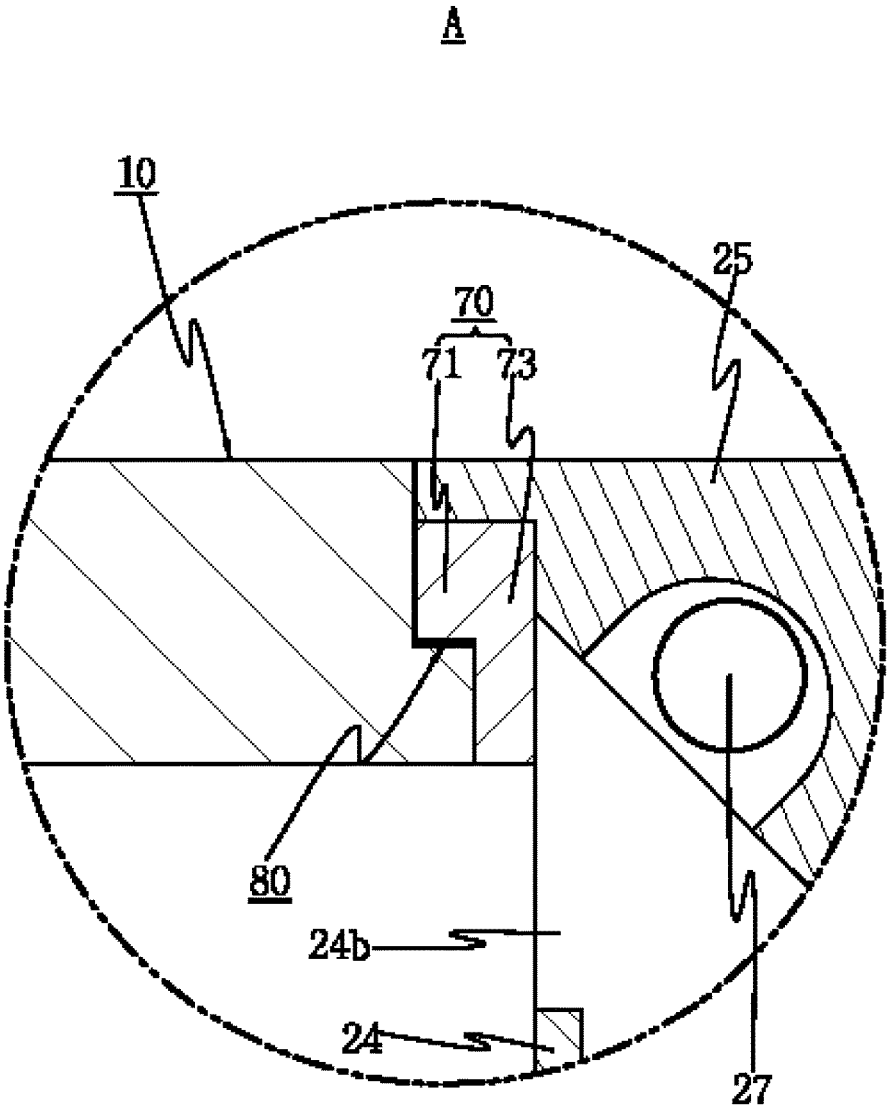

[Fig. 4]
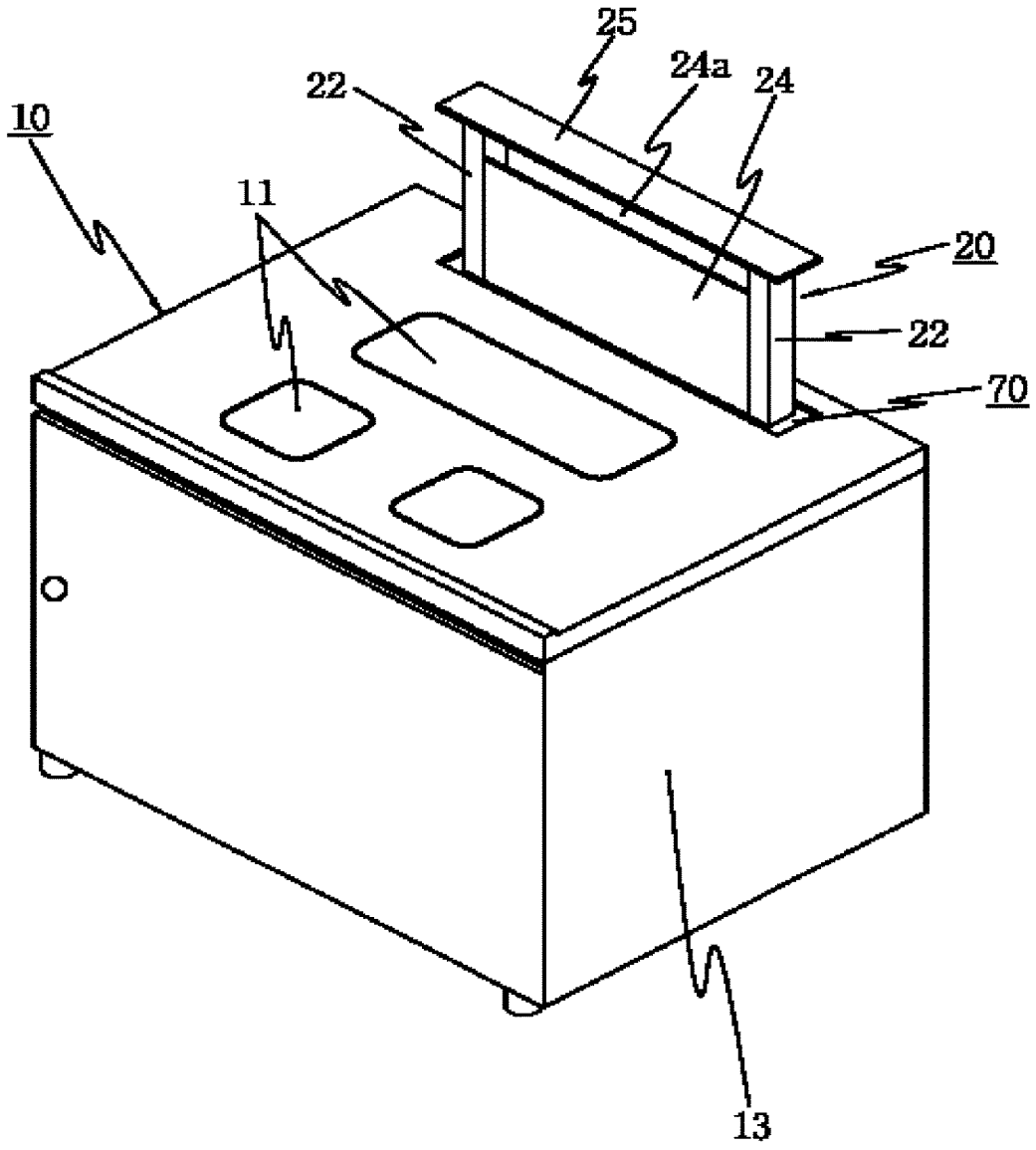

[Fig. 5]
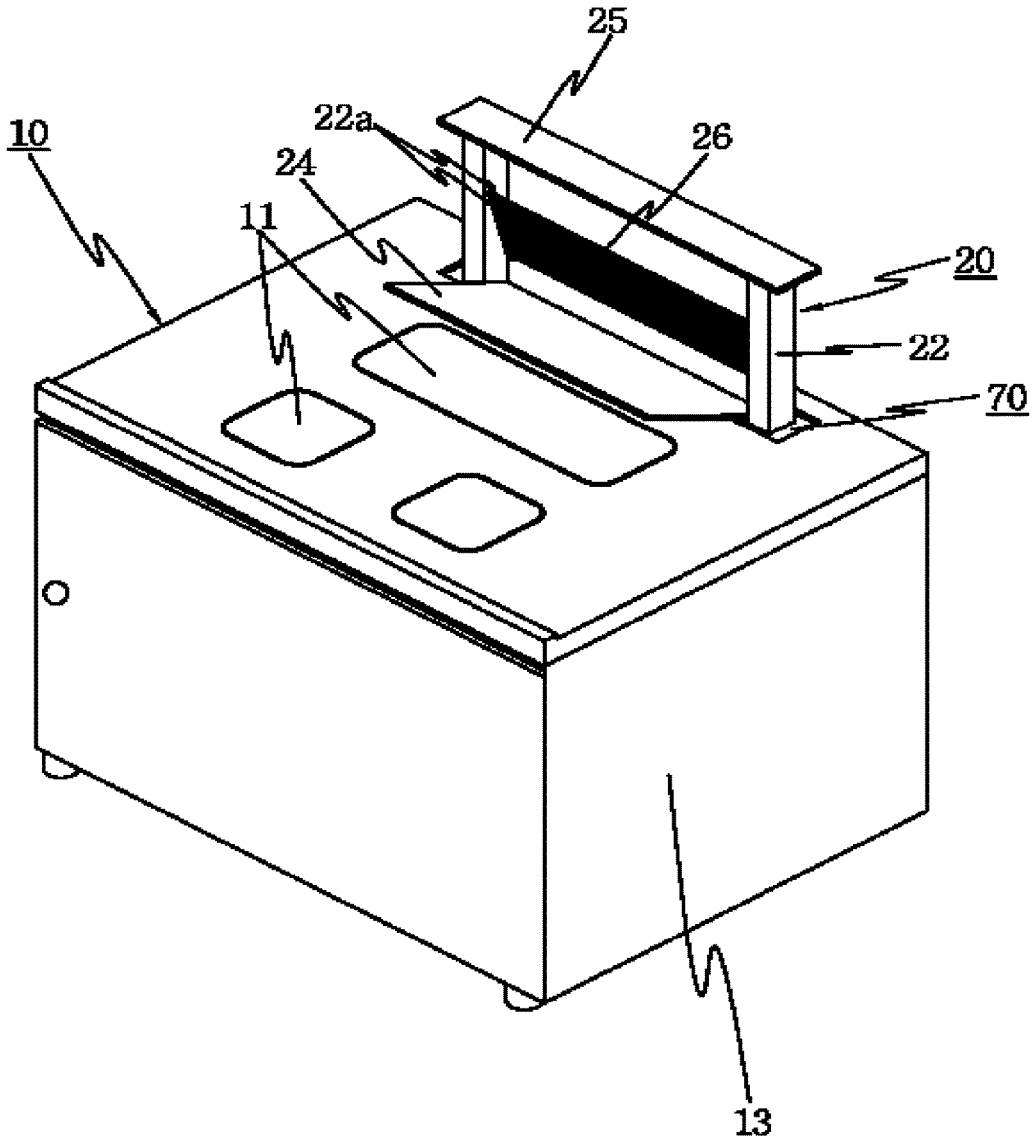

[Fig. 6]
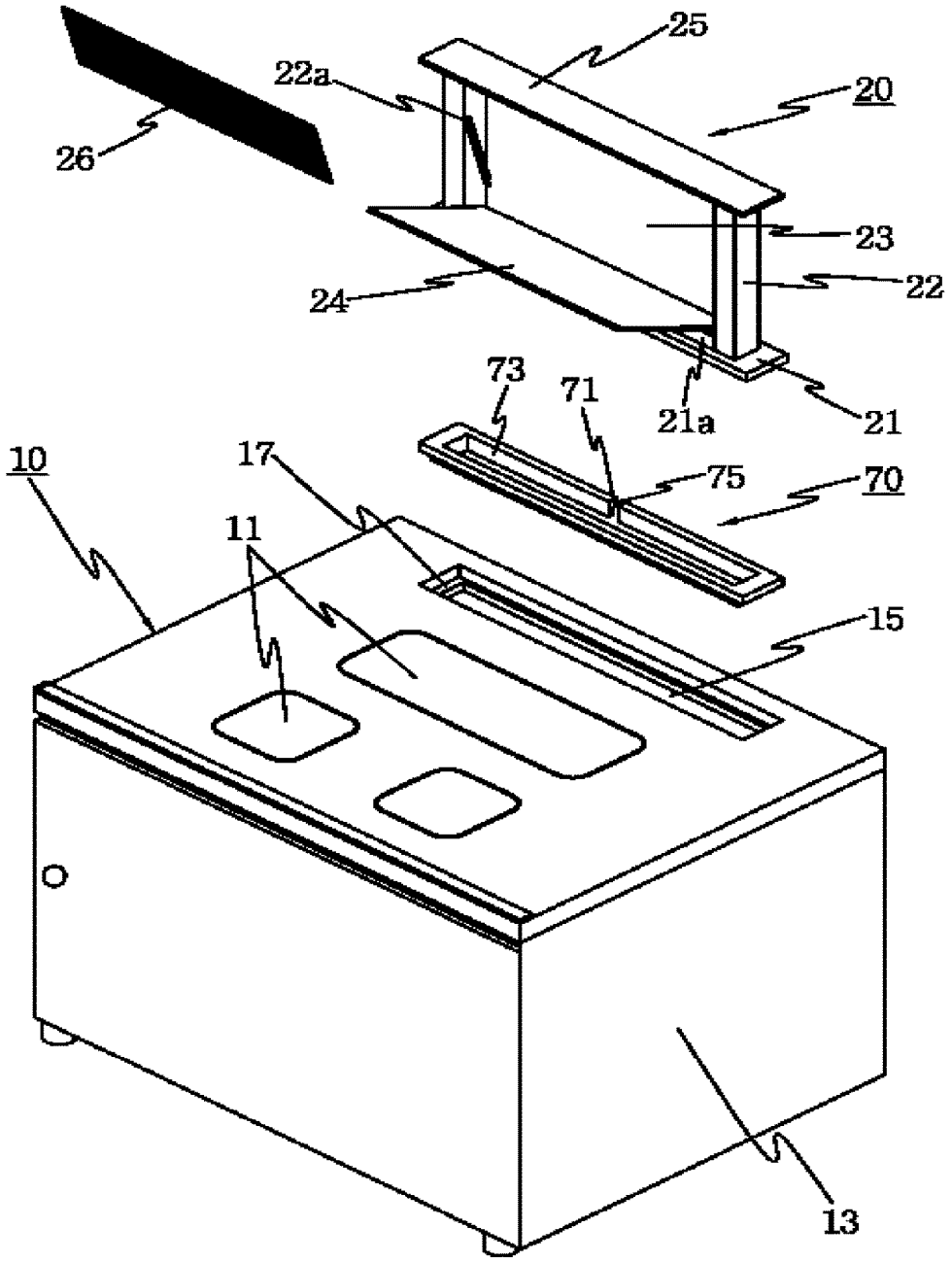

[Fig. 7]
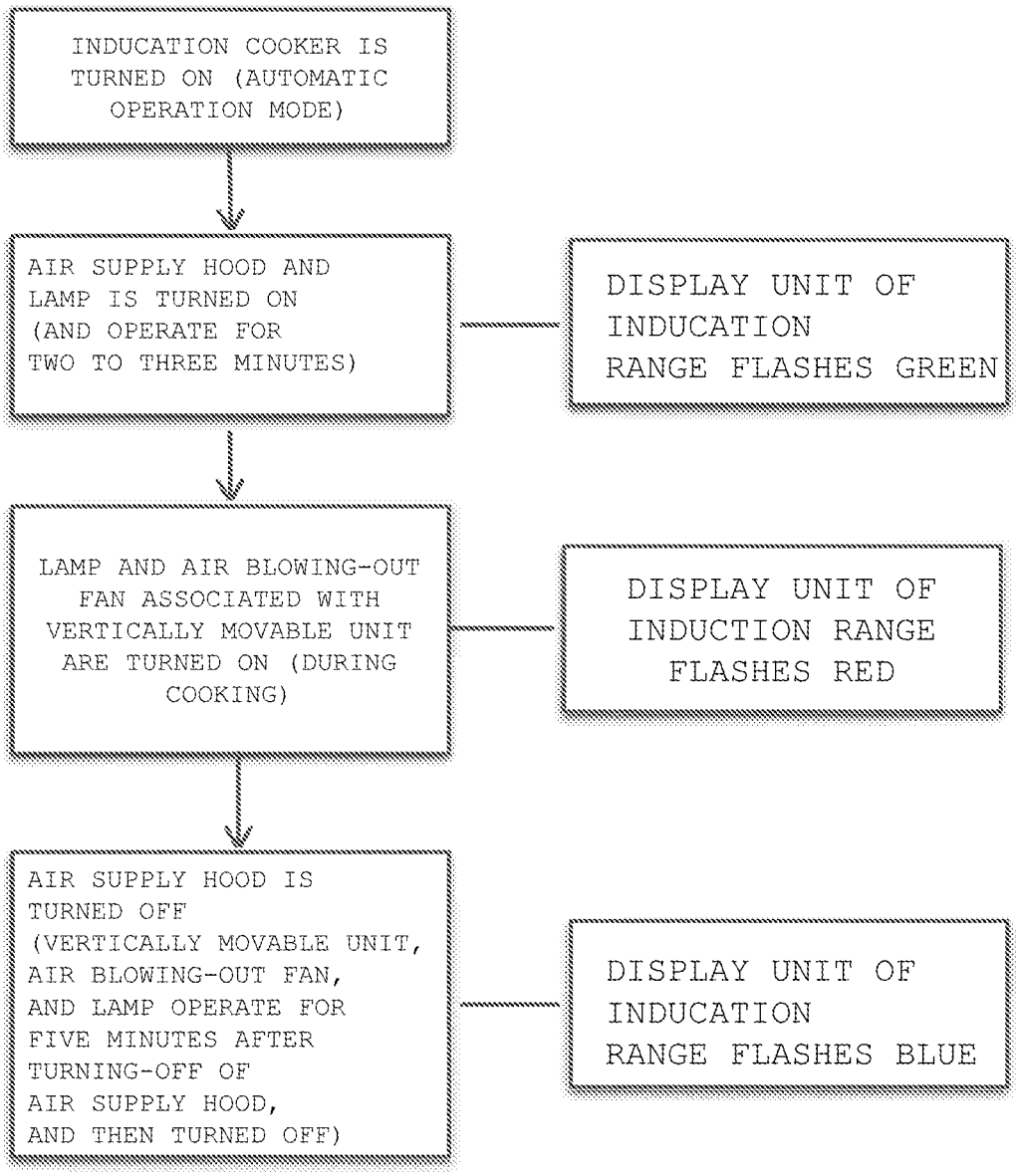

INDUCTION VENTILATION SYSTEM FOR AIR SUPPLY AND EXHAUST

BACKGROUND OF THE INVENTION

Field of the Invention

The present invention generally relates to an induction ventilation system for air supply and exhaust. More particularly, the present invention relates to an induction ventilation system for air supply and exhaust that has advantages of: easily exhausting indoor air containing vapor by installing a vertically movable unit that exhausts contaminated indoor air, in a rear portion of a first storage portion; enabling easy removal of grease by collecting grease condensed on the wall of an air suction passage, a filter, a flexible duct, and a chamber and that falls down due to its weight, using an grease tray while contaminated indoor air is being discharged through the air suction passage, filter, flexible duct, and chamber; illuminating a cooking space with a built-in lamp so that it is unnecessary to use an additional indoor lamp when cooking; enabling easy replacement of a filter by installing a door in front of the filter; being not easily contaminated by using an air suction opening-and-closing unit that opens and closes an air suction hole by its up and down movement; allowing both a first storage portion and a second storage portion that are provided above and under an upper plate to be used by arranging an air discharging means in a rear portion of the upper plate; allowing easy installation of a fire extinguisher in an air supply hood; enabling liquid contained in the fire extinguisher to be uniformly sprayed onto the entire area of the upper plate in case of fire; and being capable of remaining clean for a long period of use by using a replaceable anti-contamination member.

Description of the Related Art

An induction range is a heater that uses electromagnetic induction for heating and is an alternative to a gas oven range. The induction range uses an induction current that is generated by magnetic field as a heat source.

Accordingly, when a vessel with a metallic bottom is placed on an induction range, eddy currents occurs on the surface of the metallic bottom due to electromagnetic induction, and the vessel is heated by the eddy currents.

A gas oven range heats a cooking vessel by combusting fuel gas. Therefore, there occurs convection current and radiant heat during cooking in case of using a gas oven range. A gas oven range can heat ambient air around the range even when a cooking vessel is not placed on the range. However, an induction range only heats the surface that is in contact with a dedicated cooking vessel. Therefore, an induction range is less dangerous than a gas oven range in terms of risk of burning or fire and has high heat efficiency. For these advantages, an induction range is becoming increasingly popular.

In addition, food on an induction range can be completely cooked, and at this point a large amount of water vapor and oil vapor are generated. Since an induction range does not increase the ambient temperature around the range, water and oil vapor that escapes a cooking vessel rapidly condenses as the vapor exits the vessel. For this reason, steam (white fog) occurs due to water or oil vapor that escapes a cooking vessel placed on an induction range.

In addition, as water or oil vapor condenses, the size of water droplets or oil sludge (grease) that is absorbed onto a filter of a range hood installed above an induction range is increased. As a result, the water droplets or grease is increased to be too big to stick on the filter, the water droplets or grease falls down, making trouble.

In order to solve this problem, Korean Patent No. 10-1208596 discloses an induction range hood.

A conventional induction range hood is hung above an induction range, and collects and discharges condensed water or oil using a filter screen and a gutter. Since an induction range hood is equipped with an exhaust fan and an exhaust duct that are used to discharge a gas, a space above the induction range hood cannot be used as a storage portion. Furthermore, when a fire extinguisher is installed, a filter screen serves as an obstruction in arranging a nozzle of a fire extinguisher. Yet furthermore, sometimes liquid that is discharged from a fire extinguisher cannot be adequately sprayed onto fire due to an inappropriate location of the fire extinguisher.

The foregoing is intended merely to aid in the understanding of the background of the present invention, and is not intended to mean that the present invention falls within the purview of the related art that is already known to those skilled in the art.

DOCUMENTS OF RELATED ART (Patent Document 1) Korean Patent No. 10-1208596

SUMMARY OF THE INVENTION

Accordingly, the present invention has been made keeping in mind the above problems occurring in the related art, and an object of the present invention is to provide an induction ventilation system for air supply and exhaust that can easily exhaust g indoor air containing vapor attributable to condensation by installing a vertically movable unit in a first storage portion, and can easily remove grease by collecting the grease that condenses on the wall of an air suction passage, a filter, a flexible duct, and a chamber using a grease tray while indoor air containing oil is being discharged.

Another object of the invention is to provide an induction ventilation system for air supply and exhaust that has a built-in lamp so that it is unnecessary to use an additional indoor lamp when cooking, enables easy replacement of a filter by installing a door in front of the filter, and maintains a clean state by using an air suction opening-and-closing unit that opens and closes an air suction hole according to its up and down movement.

A further object of the invention is to provide an induction ventilation system for air supply and exhaust that enables both a first storage portion and a second storage portion that are provided above and under an upper plate to be used by arranging an air discharging means in a rear portion of the upper plate, enables easy installation of a fire extinguisher in an air supply hood, and enables liquid contained in the fire extinguisher to be uniformly sprayed onto the entire area of the upper plate in case of fire.

A yet further object of the invention is to provide an induction ventilation system for air supply and exhaust that includes a support protrusion provided in a lift hole formed in the upper plate and an anti-contamination member that comes into contact with the surface of the vertical movable unit, thereby preventing foreign matter or grease generated during cooking from entering into the first storage portion through the lift hole. The anti-contamination member is provided with an opening and is attached via an attachment means so that it can be easily picked up and replaced. Therefore, the anti-contamination member can remain clean.

According to one aspect, there is provided an induction ventilation system for air supply and exhaust, including: an upper plate that is unified with an upper portion of a first storage portion of a sink table, has a lift hole that communicates with the first storage portion in a rear portion thereof, and has an induction heating portion on an upper surface thereof; a vertically movable unit that is arranged in a position corresponding to the lift hole formed in the upper plate, moves up and down by a lift means, and forms an air suction passage; an air suction and discharge unit that includes a chamber arranged in a lower portion of the first storage portion, a flexible duct connected between the vertically movable unit and the chamber, an air suction fan that is installed in the chamber and sucks in indoor air through an air suction passage, and an air discharging pipe through which the indoor air drawn by the air suction fan is discharged outside; a grease tray that is installed under the chamber of the air suction and discharge unit and collects grease from the indoor air that is drawn by the air suction fan; an air supply hood that is arranged above the upper plate and supplies air to the upper plate by using an air supply fan to guide indoor air to the air suction passage of the vertically movable unit; and a second storage portion that is unified with an upper portion of the air supply hood.

In the induction ventilation system for air supply and exhaust, the vertically movable unit for air exhaust is installed in a rear portion of the first storage portion by vertically moving up and down. Therefore, it is possible to easily discharge indoor air containing vapor outside a room. In addition, since it is possible to collect oil that condenses as grease on the wall of the air suction passage, the filter, the flexible duct, and the chamber within the grease tray using the weight of oil, grease can be easily removed.

According to the embodiment of the present invention, a user can cook even without turning on an additional indoor lamp by using a lamp that is built into the vertically movable unit. In addition, the filter that is inserted into filter slots can be easily replaced through a door installed in front the filter. The induction ventilation system can remain clean while unused by preventing contaminants from sticking thereto by using an air suction opening-and-closing unit that opens and closes the air suction hole according to up and down movement of the vertically movable unit.

In addition, since an air discharging means is arranged in a rear portion of the upper plate, both of the first and second storage portions provided above and under the upper plate can be used. This arrangement also enables easy installation of a fire extinguisher in the air supply hood and enables liquid contained in the fire extinguisher to be uniformly sprayed onto the entire area of the upper plate in case of fire.

In addition, since a support protrusion is formed in the lift hole formed in the upper plate and an anti-contamination member that comes into contact with the surface of the vertically movable unit is provided on the support protrusion, it is possible to prevent foreign matter or grease that is generated during cooking from entering into the first storage portion through the lift hole. In addition, since the anti-contamination member can be detachably attached to the support protrusion via an attachment means and removed through an opening, the anti-contamination member can be easily replaced. Therefore, the induction ventilation system may remain clean.

BRIEF DESCRIPTION OF THE DRAWINGS

FIG. 1 is a cross-sectional view illustrating an induction ventilation system for air supply and exhaust;

FIG. 2 is an enlarged cross-sectional view illustrating a state in which a vertically movable unit, an air suction and discharge unit, and a grease tray are connected to an upper plate;

FIG. 3 is an enlarged view of a portion A of FIG. 2;

FIG. 4 is a perspective view illustrating a state in which the vertically movable unit is moved up;

FIG. 5 is a perspective view illustrating a state in which a door of the vertically movable unit is opened;

FIG. 6 is an exploded perspective view illustrating the upper plate, the vertically movable unit, and an anti-contamination member; and FIG. 7 is a flowchart illustrating an operation flow of the induction ventilation system that operates in automatic operation mode.

DETAILED DESCRIPTION OF THE INVENTION

Hereinafter, a preferred embodiment of the present invention will be described.

FIGS. 1 through 7 illustrate an induction ventilation system for air supply and exhaust 100 according to one embodiment of the present invention. The induction ventilation system 100 performs ventilation by supplying outdoor air into a kitchen and discharging indoor air outside the kitchen while food is being cooked on an induction range. The induction ventilation system 100 includes an upper plate 10, a vertically movable unit 20, an air suction and discharge unit 30, a grease tray 40, an air supply hood 50, and a second storage portion 60.

The upper plate 10 is unified with an upper portion of a first storage portion 13 of a sink table. An induction heating portion 11 that heats a cooling vessel 1 using electromagnetic induction is installed on an upper surface of the upper plate 10. The induction heating portion 11 is the basic form of a known induction range. Therefore, details of the induction heating portion 11 will not be described here.

A lift hole 15 that communicates with the first storage portion 13 is formed in a rear portion of the upper plate 10. The vertically movable unit 20 moves up and down through the lift hole 15.

A support protrusion 17 is provided at the edge of the lift hole 15 formed in the upper plate 10. The support protrusion 17 is preferably provided with an anti-contamination member 70 that comes into contact with the surface of the vertically movable unit 20. The anti-contamination member 70 fills a gap between the vertically movable unit 20 and the lift hole 15, thereby preventing contaminants or grease from flowing along the surface of the vertically movable unit 20 and from entering into the first storage portion 13.

The anti-contamination member 70 includes a base portion 71 that is supported on the support protrusion 17 in the lift hole 15 via an attachment means 80, and a contact portion 73 that is unified with the base portion 71 and comes into tight contact with the inside surface of the lift hole 15 and with the vertically movable unit 20.

The anti-contamination member 70 may have an opening 75 that allows a user to easily pick up the anti-contamination member 70 so that the anti-contamination member 70 can be easily replaced when the anti-contamination member 70 becomes dirty due to a long period of use. The contact portion 73 may be formed of a cushioning member or a brush not to impede up-down movement of the vertically movable unit 20.

The attachment means 80 may be an adhesive. In this case, the anti-contamination member 70 may be attached to the support protrusion 17 formed in the lift hole 15. However, it is preferable that the attachment means 80 be Velcro so that the anti-contamination member 70 can be easily detached and then replaced as necessary. When the attachment means 80 is Velcro, an upper portion of the support protrusion 17 and a lower portion of the base portion 71 of the anti-contamination member 70 are formed to correspond to each other.

The vertically movable unit 20 is located in a position corresponding to the lift hole 15 of the upper plate 10 and is moved up and down by a lift means (not shown). The vertically movable unit 20 is installed in an air suction passage 24*a* through which indoor air is drawn from an indoor space and discharged outside through the air suction and discharge unit 30. The lift means is installed in the first storage portion 13 and may be formed as a typical lifter so that the vertically movable unit 20 is moved up and down by the lift means.

Hereinafter, the vertically movable unit 200 will be further detailed.

The vertically movable unit 20 moves up and down to discharge indoor air outside a room (kitchen) during cooking. The vertically movable unit 20 includes a lift plate 21, vertical plates 22, a back plate 23, a door 24, an air suction opening-and-closing unit 25, a filter 26, and a lamp 27.

The lift plate 21 is connected to the lift means, thereby moving the vertically movable unit 20 up and down according to operation of the lift means. The lift plate 21 is larger than the lift hole 15 and limits the lifting height of the vertically movable unit 20. The vertically movable unit 20 is installed in the first storage portion 13 and is provided with an air suction passage 21*a* through which indoor air (exhaust gas) passes.

The vertical plates 22 are positioned at both edges of the lift plate 21. The vertical plates 22 are distanced from each other with the air suction passage 21*a* therebetween and lower ends of the vertical plates 22 are inserted into the lift hole 15 formed in the upper plate 10. Opposing surfaces of the vertical plates 22 are provided with respective filter slots 22*a*. The filter slots 22*a* are inclined at a predetermined angle so that air that passes through the air suction passage 21 can pass the filter 26.

The back plate 23 is a well-known ordinary plate and closes a rear side of the vertical plates 22 to form the air suction passage 24*a* between the vertical plates 22.

The door 24 is attached to the front surfaces of the vertical plates 22 to form the air suction passage 24*a*. The door 24 is attached to the vertical plates 22 via hinge in order to enable replacement of the filter 26 that is inserted into the filter slots 22*a*. The door is shorter than the vertical plates 22 and the air suction hole 24*b* that communicates with the air suction passage 24*a* is provided above the door 24.

The air suction opening-and-closing unit 25 connects upper portions of the vertical plates 22 to each other and has the same size as the lift hole 15, thereby opening and closing the air suction hole 24*b*.

The filter 26 is inserted into the filter slots 22*a* of the vertical plates 22 as described above, and filters out contaminants contained in indoor air that is taken into the air suction passage 24*a*.

The lamp 27 is combined with the vertical plates 22 and is installed in the air suction passage 24*a*. The lamp 27 illuminates the upper plate 10 through the air suction hole 24*b*.

The air suction and discharge unit 30 is connected with the vertically movable unit 20 to draw and discharge indoor air through the air suction hole 24*b* and the air suction passage 24*a*. The air suction and discharge unit 30 forms a chamber 31 in a lower portion of the first storage portion 13. The chamber 31 has a grease drain hole 31*a* at a lower end thereof to drain grease that is collected from the indoor air that is drawn by the vertically movable unit. The chamber 31 has an air discharge hole in a rear portion thereof to discharge indoor air that is drawn.

The chamber 31 is in contact with the wall 9 and extends through the rear surface of the first storage portion 13 for the purpose of discharge of indoor air that is drawn from the indoor space. The first storage portion 13 and the chamber 31 are provides with respective through holes that correspond to each other. For safe and stable installation, it is preferable that the chamber 31 be fixed to the inside rear surface of the first storage portion 13.

The air suction and discharge unit 30 may further include a flexible duct 33 that is connected between the vertically movable unit 20 and the chamber 31. The flexible duct 33 is used to smoothly draw indoor air when the height of the vertically movable unit 20 is adjusted.

The air suction and discharge unit 30 includes an air suction fan 35 that is installed in the rear surface of the chamber 31 and draws indoor air through the air suction passage 24*a*, and a discharge pipe 37 that is connected to the air discharge hole of the chamber 31 to discharge the indoor air that is drawn by the air suction fan 35 outside a room. A through hole is formed in the wall 9 so that the discharge pipe 37 is inserted into the through hole in the wall 9 and the indoor air that is drawn through the discharge pipe 37 can be discharged outside.

The grease tray 40 is installed in a lower portion of the chamber 31 of the air suction and discharge unit 30 and collects grease discharged through the grease drain hole 31*a* formed in the lower end of the chamber 31. The grease means condensed oil that is formed on the inside surface of the filter 26, the flexible duct 33, and the chamber 31 while oil-containing air is passing through the filter, flexible duct, and chamber.

The grease tray 40 is separately installed in a lower portion of the chamber 31. A handle is attached to the front surface of the great tray 40 so that grease in the great tray 40 can be easily removed.

The grease tray 40 is installed at the bottom of the first storage portion 13 so that the grease can be easily removed through the door of the first storage portion 13. Alternatively, a through hole is formed in the bottom plate of the first storage portion 13 and the grease tray 40 may be installed at the bottom of a sink table so that grease can be collected in the great tray as it falls down and passes through the through hole formed in the bottom plate of the first storage portion 13.

An air supply hood 50 is arranged above the upper plate 10 and has a well-known structure that supplies air toward the upper plate. The air supply hood 51 includes an air supply fan 51 that is well known and has a ventilation hole 53 at a lower end portion of a front portion thereof. Air can be vertically or obliquely supplied by the air supply fan 51 through the ventilation hole 53.

The air supply hood 50 is equipped with a fire extinguisher 55. According to the embodiment of the present invention, since the structure for discharging exhaust gas is separately provided in a rear portion of the upper plate 10, the fire extinguisher 55 and a spray nozzle 57 can be installed in the center of the upper plate 10 without any interference of other parts. Furthermore, a lamp for lighting also can be easily installed.

Therefore, when the air supply fan 51 of the air supply hood 50 starts operating, air is supplied to the upper plate. As a result, indoor air is guided to the air suction passage 24*a* of the vertically movable unit 20, and condensation is suppressed. Furthermore, since a fire-extinguishing liquid is uniformly sprayed to the entire area of the upper plate 10 through the spray nozzle 57 from the fire extinguisher 55 installed at the center of the upper plate in case of fire, fire can be easily put out.

The second storage portion 60 has a known structure and is unified with an upper portion of the air supply hood 50. Since the structure for discharging exhaust air is separately installed in a rear portion of the upper plate as described above, the second storage portion 60 may be an empty space so that it can be used as a storage space.

Hereinafter, operation of the induction ventilation system according to the embodiment of the present invention will be described below.

In automatic operation mode, when a cooking vessel 1 is placed on the induction heating portion 11 of the upper plate 10, the air supply hood 50 and the lamp are simultaneously turned on according to control of a central controller. At this point, a lamp of a display unit of an induction range flashes green and the induction range becomes ready to heat the cooking vessel 1.

The operation described above is a preliminary operation to optimize control of odor and vapor during cooking and is automatically continued for two to three minutes after a power switch is turned on.

Next, the lamp of the display unit of the induction range flashes red when the cooking vessel 1 is heated based on the principle of electromagnetic induction, thereby indicating a start of operation of the induction range. Next, when the lift means for lifting the vertically movable unit 20 detects that the cooking vessel 1 is heated, the vertically movable unit 20 moves up and the air suction hole 24*b* is opened.

When the vertically movable unit 20 completely moves up, the air suction fan 35 of the air suction and discharge unit 30 automatically starts operating in medium or strong mode. When the air suction fan 35 automatically starts operating, indoor air that is drawn through the air suction hole 24*b* passes through the air suction passage 24*a*, the flexible duct 33, and the chamber 31 and is finally discharged outside. The indoor air that is drawn into the air suction passage 24*a* passes through the filter 26 inserted into the filter slots 22*a* while it passes through the air suction passage 24*a*. Therefore, indoor air quality can be maintained.

While the indoor air passes through the air suction passage 24*a*, flexible duct 33, filter 26, and chamber 31, an oil component contained in the indoor air condenses. The condensate oil passes through the grease drain hole 31*a* of the chamber 31 and is gradually collected in the grease tray 40. The grease collected in the grease tray 40 can be easily removed through the door of the first storage portion 13.

When the air suction fan 35 operates, the air supply fan 51 of the air supply hood 50 also starts operating. In this way, indoor air can be drawn into the air suction hole 24*b*. With this operation, it is possible to prevent the scent of food from diffusing into other rooms during cooking, so that fresh air quality can be maintained.

On the other hand, while a portion of indoor air that is drawn into the air suction hole 24*b* collides with the vertically movable unit 20, oil components and contaminants in the air condense on the surface of the vertically movable unit 20 and the condensed water or oil flows down. In this case, there is a risk that the condensed water or oil enters into the first storage portion 13 through the lift hole 15. Therefore, according to the embodiment of the present invention, the anti-contamination member 70 that is installed in the lift hole 15 prevents contaminants including oil components from entering into the first storage portion 13. In addition, since the anti-contamination member 70 is detachably attached by the attachment means 80 such as Velcro and is provided with an opening therein, the anti-contamination member can be easily replaced as necessary. Therefore, the anti-contamination member 70 can remain clean.

After cooking is completed, the cooking vessel 1 is removed from the induction heating portion on the upper plate 10. At this point, the lamp of the display unit of the induction range flashes blue according to control of the central controller and the air supply fan 51 stops operating. After that, the lamp and the air suction fan 35 continuously operate for about five minutes and are then automatically turned off. As the lamp and the air suction fan 35 are turned off, the vertically movable unit 20 moves down. This operation is called "post operation".

The operation of the air suction fan 35 prevents the scent of cooked food from diffusing into rooms other than a kitchen when food in the cooking vessel 1 is put on a dish or bowl and enables easy discharge of existing food odors from the kitchen. At this point, the air suction fan 35 operates in weak mode because it is not necessary to strongly draw indoor air, so that noise of the fan is decreased. By repeatedly performing the above operation, quality of indoor air can be maintained during cooking.

According to the embodiment of the present invention described above, the vertically movable unit, the air suction fan 35, and the air supply fan 51 are automatically operated when the induction heating portion 11 starts heating. However, the vertically movable unit 20, the air suction fan 35, and the air supply fan 51 may be manually operated.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An induction ventilation system for air supply and exhaust, comprising:

an upper plate that has an induction heating portion that heats a cooking vessel based on electromagnetic induction, on an upper surface thereof, is unified with an upper portion of a first storage portion within a sink table, and has a lift hole communicating with the first storage hole, in a rear portion thereof;

a vertically movable unit that is installed in a position corresponding to the lift hole of the upper plate, is moved up and down by a lift means installed in the first storage portion, and includes a filter provided in an air suction passage;

an air suction and discharge unit including a chamber that is installed in a lower rear portion of the first storage portion and is provided with an oil drain hole at a lower end thereof, a flexible duct connected between the vertically movable unit and the chamber, an air suction fan that is installed in the chamber and draws indoor air through the air suction passage, and a discharge pipe that is connected to the chamber and through which indoor air drawn by the air suction fan is discharged outside a room;

a grease tray that is installed under the chamber to collect grease that condenses on surfaces of the air suction passage, the filter, the flexible duct, and the chamber and flows down through the grease drain hole;

an air supply hood that is installed above the upper plate and guides the indoor air to the air suction passage in the vertically removable unit by supplying air to the upper plate using an air supply fan; and a second storage portion unified with an upper portion of the air supply hood, wherein the lift hole in the upper plate is provided with a support protrusion and an anti-contamination member that comes into tight contact with a surface of the vertically movable unit is supported on the support protrusion.

2. The induction ventilation system according to claim 1, wherein the anti-contamination member includes a base portion supported on the support protrusion provided via an attachment means, and a contact portion that is unified with the base portion and comes into tight contact with an inside surface of the lift hole and the vertically movable unit, and wherein the anti-contamination member is provided with an opening by which the anti-contamination member is easily held when replaced, and wherein the contact portion is formed as a cushioning member or a brush.

3. The induction ventilation system according to claim 2, wherein the attachment means is Velcro that is shaped to correspond to the support protrusion in the lift hole and to the base portion of the anti-contamination member and that is detachably attached.

4. The induction ventilation system according to claim 1, wherein the vertically movable unit includes:

a lift plate that is arranged in the first storage portion, is connected to the lift means, and provides a passage therein;

vertical plates that are distanced from each other, arranged at respective edges of the lift plate, inserted into the lift hole of the upper plate, and provided with respective filter slots on respective opposing surfaces thereof;

a rear plate that closes a rear side of the vertical plates;

a door that is attached to the vertical plates via hinge to open and close a front side of the vertical plates, forming an air suction passage between the vertical plates and is provided with an air suction hole there above;

an air suction opening-and-closing unit that connects upper portions of the vertical plates and opens and closes the air suction hole according to up and down movement thereof;

a filter that is inserted into the filer slots formed in the vertical plates and filters out contaminants from indoor air that is drawn into the air suction passage; and a lamp that is combined with the vertical plates and arranged in the air suction passage and that illuminates the upper plate through the air suction hole.

* * * * *